US009388020B2

(12) United States Patent
Peacock et al.

(10) Patent No.: US 9,388,020 B2
(45) Date of Patent: Jul. 12, 2016

(54) METHOD AND AN ELEVATOR ARRANGEMENT

(71) Applicants: Mark Peacock, Riihimaki (FI); Jussi Perälä, Hyvinkaa (FI)

(72) Inventors: Mark Peacock, Riihimaki (FI); Jussi Perälä, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 283 days.

(21) Appl. No.: 14/020,027

(22) Filed: Sep. 6, 2013

(65) Prior Publication Data

US 2014/0000987 A1 Jan. 2, 2014

Related U.S. Application Data

(63) Continuation-in-part of application No. 13/779,091, filed on Feb. 27, 2013.

(30) Foreign Application Priority Data

Mar. 6, 2012 (EP) ..... 12158197

(51) Int. Cl.

| | |
|---|---|
| ***B66B 19/00*** | (2006.01) |
| ***B66B 11/00*** | (2006.01) |
| ***B66B 9/187*** | (2006.01) |
| *E04H 12/34* | (2006.01) |

(52) U.S. Cl.

CPC ..... *B66B 19/00* (2013.01); *B66B 9/187* (2013.01); *B66B 19/007* (2013.01); *B66B 11/00* (2013.01); *E04H 12/34* (2013.01)

(58) Field of Classification Search

CPC ..... B66B 9/187; B66B 19/00; B66B 19/002; B66B 19/04; E04H 12/18; E04H 12/34

USPC ..... 52/741.1, 745.17

See application file for complete search history.

(56) References Cited

U.S. PATENT DOCUMENTS

| | | | | |
|---|---|---|---|---|
| 5,560,730 | A * | 10/1996 | Gillard et al. | 403/294 |
| 2005/0150728 | A1* | 7/2005 | Van Der Meijden et al. | 187/411 |
| 2007/0181381 | A1* | 8/2007 | Jungbauer | B66B 9/187 187/401 |
| 2009/0223751 | A1 | 9/2009 | Peacock et al. | |
| 2010/0133048 | A1* | 6/2010 | Barneman | 187/414 |

(Continued)

FOREIGN PATENT DOCUMENTS

| | | |
|---|---|---|
| EP | 2284113 A2 | 2/2011 |
| FR | 2694279 A1 | 2/1994 |

(Continued)

OTHER PUBLICATIONS

International Search Report for EP12158197.9, dated Aug. 7, 2012.

(Continued)

*Primary Examiner* — William A Rivera
*Assistant Examiner* — Stefan Kruer
(74) *Attorney, Agent, or Firm* — Harness, Dickey & Pierce, P.L.C.

(57) ABSTRACT

A method and elevator arrangement wherein a roof structure is lifted higher in a hoistway so as to make more room below the roof structure, the roof structure being a movable roof structure, and in that the movable roof structure is lifted in the hoistway taking support for the lift from a second movable support structure mounted in the hoistway above the roof structure.

24 Claims, 4 Drawing Sheets

(56) References Cited

U.S. PATENT DOCUMENTS

| | | | | |
|---|---|---|---|---|
| 2011/0113720 | A1* | 5/2011 | Peacock et al. | 52/741.1 |
| 2012/0272612 | A1* | 11/2012 | Peacock | B66B 11/0045 52/742.14 |
| 2012/0291395 | A1* | 11/2012 | Plathin | 52/741.1 |

FOREIGN PATENT DOCUMENTS

| | | | | |
|---|---|---|---|---|
| JP | 03264482 | A * | 11/1991 | B66B 7/00 |
| WO | WO 7923 | A1 * | 2/2000 | B66B 19/00 |
| WO | WO 0050328 | A2 * | 8/2000 | B66B 19/00 |
| WO | WO-2004/050526 | A1 | 6/2004 | |
| WO | WO 2011148033 | A1 * | 12/2011 | B66B 19/02 |

OTHER PUBLICATIONS

Office Action for corresponding U.S. Appl. No. 13/779,091 dated Aug. 31, 2015.

* cited by examiner

METHOD AND AN ELEVATOR ARRANGEMENT

This application is a continuation-in-part-application of U.S. application Ser. No. 13/779,091, filed on Feb. 27, 2013, which claims priority to European patent application number EP 12158197.9, filed on Mar. 6, 2012, the entire contents of which is hereby incorporated herein by reference.

FIELD OF THE INVENTION

The object of the invention is a method in constructing an elevator, and an elevator arrangement, the elevator being suitable for transporting passengers and/or goods during construction-time thereof.

BACKGROUND OF THE INVENTION

The invention relates generally to extending the service zone of a construction time elevator to reach higher in the elevator hoistway. In connection with so-called jump-lifts, the bottom part of an elevator hoistway is taken into use already before the building has been completed. In this case the top part of the elevator hoistway can be constructed at the same time as an elevator moving in the bottom part of the elevator hoistway already serves people on the lower floors of the building. Generally in jump-lifts the elevator car moving in the lower parts of the elevator hoistway is supported by a movable supporting platform positioned above the car in the hoistway. Often the car is moved during construction-time use with a hoisting machine supported on this supporting platform, but alternative locations for the hoisting machine also exist. The installation work in the parts of the elevator hoistway above this supporting platform is performed from a movable platform or corresponding in the elevator hoistway, which installation work comprises, among other things, the installation of guide rails and electrification in the elevator hoistway. When the elevator hoistway under construction above the supporting platform has reached a sufficient stage of completion, the completed part of the elevator hoistway can be taken into use. In this case a jump-lift is performed, where the supporting platform is raised and mounted to a higher position in the elevator hoistway. It is preferable to have a roof structure above the supporting platform, which is separate from the movable support, which roof structure forms a protective cover against weather and falling objects. The roof structure has formed the uppermost structure in the elevator hoistway beneath which all the work in the hoistway has been done. The roof structure has been positioned high above the supporting platform so as to enable working between the supporting platform and the roof structure. When the building under construction has reached a certain height or construction otherwise has reached a certain point a new roof structure has been built above the earlier and the earlier roof structure has been dismantled. The disadvantage of this procedure has been that it necessitates simultaneous presence of several roof structures. Alternatively, it is possible to lift structures of the roof structure with a worksite crane used in the construction of the building and rebuild it in a higher position. One problem with this type of arrangement is that the worksite crane is not always available when needed. When the elevator hoistway has reached its final height, a machine room has conventionally been built at the end of the elevator hoistway and after that the final machinery of the elevator has been brought there. Taking into account the above presented, a need for an improved solution for positioning the roof structure has come up.

BRIEF DESCRIPTION OF THE INVENTION

The object of the invention is to introduce an improved method and an elevator arrangement. The object of the invention is, inter alia, to solve drawbacks of known solutions and problems discussed later in the description of the invention. It is also an object to allow the lifting of the roof structure to be independently prepared and performed without haste and without disturbing other processes taking place simultaneously. Embodiments are presented which, inter alia, facilitate simple, safe and efficient repositioning of a roof structure. Also, embodiments are presented, where access to the lifting equipment is good and safe working position and good ergonomics can be ensured. Also, embodiments are presented, where the lifting of the roof structure can be prepared at least to a great extent without using electrically driven lifting devices.

The method in constructing an elevator according to the invention concerns an elevator which is or has been arranged to comprise during construction time a hoistway, at least one elevator unit movable in the hoistway, including at least an elevator car, a first movable support structure in the hoistway above the elevator car for supporting said at least one elevator unit (for example with a roping connected between elevator unit(s) and the support structure), and a roof structure, which is separate from the first movable support structure and positioned in the hoistway above the first support structure. In the method at least the following steps are performed:

a) the elevator car is used for transporting passengers and/or goods, and thereafter
b) the first movable support structure is lifted higher in the hoistway, and thereafter
c) the elevator car is used again for transporting passengers and/or goods, At a suitable stage a second movable support structure is (or has been) mounted in the hoistway above the roof structure. The method further comprises a step x wherein the roof structure is lifted higher in the hoistway so as to make more room below the roof structure, the roof structure being a movable roof structure. In step x the movable roof structure is lifted in the hoistway taking support for the lift from a second movable support structure mounted in the hoistway above the roof structure. Thus, the roof structure can be moved independently of other processes of the construction of the building or the elevator components below it. Furthermore, during the lifting of the roof structure, the elevator below it may be kept in use. Thus, the lifting of the roof structure can be prepared and carried out without haste. The roof structure being movable it can be lifted in such state that it protects the elevator components below it also during lifting. For this purpose, the lifting of the roof structure is preferably performed without substantial dismantling thereof.

In a preferred embodiment in step x the movable roof structure is lifted with a lifting arrangement which is in the hoistway, the lifting arrangement comprising the second movable support structure mounted in a mounting position above the roof structure, and preferably also a rope or equivalent and a lifting device. The lifting device may be an electrically powered lifting device, although also alternatively powered devices may be suitable for this purpose.

In a preferred embodiment so as to enable a following step x a step e is performed where at least part(s) of the lifting arrangement is/are lifted manually by a person to extend to the level of said mounting position, preferably by carrying and/or by pulling part(s) up with a rope or equivalent to the level of said mounting position. Thus the lifting of the roof structure can be prepared at least to a great extent without using electrically driven lifting devices. In this way, the movable second support structure can be lifted to its first mounting position for or to any later mounting position. The lifting height is preferably as at least as great as the distance between successive landings (e.g. 2.5 meters or more), but preferably greater (e.g. 5-50 meters).

In a preferred embodiment in step e a rope or equivalent by which the support for the lift of the movable roof structure is arranged to be taken from the second movable support structure and/or the second support structure is/are lifted to extend to the level of said mounting position manually by a person, such as by carrying or by pulling it/them up. The pulling is preferably done with a rope or equivalent. By manually lifting it/them, a single person can carry out considerable amount of preparation work of the lift without disturbing other on-going installation or construction processes. In this way the method can be kept also effective and simple as manual processes don't necessitate providing external energy, such as electricity.

In a preferred embodiment in step e a rope or equivalent is set to extend vertically in the hoistway, preferably by dropping it into the hoistway, preferably from an intended mounting position, and connected to part(s) of the lifting arrangement, after which said part(s) is/are lifted manually by a person, by pulling the rope or equivalent. In this way the person can perform the lifting safely and said part(s) can be lifted long distances.

In a preferred embodiment step x is performed plural times to stepwise make more room below the movable roof structure, and after performing step x, said step e is performed, where the second support structure is moved from an earlier mounting position above the roof structure upwards to a higher mounting position in the hoistway for a subsequent step x, after which the step x is performed again.

In a preferred embodiment step b, preferably a step cycle comprising steps a to c, is performed once or plural times before performing step x.

In a preferred embodiment step b, preferably a step cycle comprising steps a to c is performed once or plural times after performing step x.

In a preferred embodiment the elevator comprises a third movable support structure between said first movable support structure and second movable support structure, and before step b the third support structure is lifted higher in the hoistway. In this way the first supporting structure can climb upwards in the hoistway independently of the roof structure.

In a preferred embodiment the elevator comprises a movable working platform below the movable roof structure, and elevator structures are installed by working on the working platform. Preferably, the working platform is moved by taking support from the movable roof structure mounted above the working platform. In this way several relatively light functions can be integrated in the same movable structure.

In a preferred embodiment after step x the hoistway is sealed water-proof with the roof structure. In this way the components below it can be kept dry.

In a preferred embodiment during the method the hoistway is protected with an impact absorbing protection deck comprising an impact absorbing sandwich structure with the roof structure. In this way the major risks are reduced when working in hoistways below core forms/slip forms and above operating elevators, the major risks comprising the concrete itself if the formwork collapses during a pour allowing the wet concrete to fall through the hoistway, the usual risk from tools, and construction equipment etc. falling through entrances below the slip form, and hoisting heavy lift components (guides) in the construction area above the cathead.

In a preferred embodiment after step x parts of the lifting arrangement are lowered to be in unity of the movable roof structure, preferably below a waterproof roof part thereof, so as to store them the time between steps x and e. In this way the lifting parts are not exposed to water and even long time spans do not ruin them.

In a preferred embodiment in step x the movable roof structure is lifted with a lifting arrangement in the hoistway, the lifting arrangement comprising a lifting device in unity of the movable roof structure. Thus, the lifting device is easy to access.

In a preferred embodiment the elevator comprises a movable working platform below the movable roof structure, and the working platform is moved with a lifting device in unity of the movable roof structure, preferably positioned below a water-proof roof part thereof. Thus, multiple light-weighted functions are integrated in one movable structure. Also, the lifting device is easy to access and may be kept safe from water.

In a preferred embodiment the separation deck separates hoistway in two parts.

In a preferred embodiment the elevator comprises a separation deck comprising an impact absorbing sandwich structure below the movable working platform on the lifting beam or on the installation safety beam. In this way kinetic energy of falling objects is minimized by limiting the possible fall heights of objects by correct placement of the separation deck.

In a preferred embodiment the sandwich structure of the protection deck/separation deck comprises a first skin and a second skin and one or more core elements between the first skin and the second skin. In a preferred embodiment, core elements comprise a fiber board, a steel plate, and a corrugated sheet vertically superimposed. In a preferred embodiment, the core elements comprise a plywood plate, one or more steel plates, and a corrugated metal sheet between the steel plate and the second skin. In a preferred embodiment the first skin and the second skin and the corrugated metal sheet are steel plates of thickness 2-10 mm, preferably of thickness 3-6 mm.

In a preferred embodiment the number of steel plates in the sandwich structure is preferably one, two, or more depending on the impact absorbing protection capacity desired for the separation deck. In a preferred embodiment the number of plywood plates is at least one. In a preferred embodiment the plywood plate's thickness is 5-10 mm. In a preferred embodiment the impact absorbing sandwich structure is formed by joining said core elements to the first skin and the second skin preferably by adhesive bonding, welding, spot welding, riveting or by press-formed joints.

In a preferred embodiment the lifting device(s) positioned in unity of the movable roof structure is/are accessed via a platform below the water-proof roof part. Thus, accessing the lifting devices, safety and ergonomics are improved.

The elevator arrangement according to the invention comprises a hoistway, at least one elevator unit movable in the hoistway, including at least an elevator car, a first movable support structure in the hoistway above the elevator car, for supporting said at least one elevator unit, for example with a roping connected between elevator unit(s) and the support structure, and a roof structure, separate from the movable support structure, in the hoistway above the first movable support structure. The roof structure is a movable support structure, and the arrangement comprises a lifting arrangement in the hoistway for lifting the movable roof structure higher in the hoistway, the lifting arrangement comprising a second movable support structure mounted in the hoistway above the movable roof structure, the lifting arrangement being arranged to take support from the second movable support structure for said lifting of the movable roof structure. Thus, benefits as described above can be achieved.

In a preferred embodiment the movable roof structure is water-proof, preferably comprising a water-proof membrane. Preferably, the movable roof structure comprises a water-proof roof part. Preferably, the movable roof structure comprises a roof part comprising an inclined water-proof upper surface. In this way, entering of water into the hoistway beneath can be efficiently avoided.

In a preferred embodiment the arrangement comprises stairs or ladder extending to the level of the intended mounting position. They can extend between the level of the second movable support structure and a level higher than the level of the second movable support structure. In this way, a person can easily at any time move to the level of the intended new mounting position.

In a preferred embodiment the movable roof structure and one or more sidewalls of the hoistway is sealed in waterproof manner.

In a preferred embodiment the movable roof structure covers substantially the whole vertical projection of the hoistway.

In a preferred embodiment the second movable support structure is portable by a person or consists of plural parts each portable by a person detachably connected to each other.

In a preferred embodiment the second movable support structure is in the form of a beam, preferably comprising wood and/or metal as main material. In this way, it is easy to move manually and it can be formed light-weighted.

In a preferred embodiment the weight of the second movable support structure is at most 35 kg, preferably at most 25 kg, more preferably at most 20 kg in weight, or the second support structure consists of plural detachably connected parts each having a weight of 35 kg at most, preferably at most 25 kg, more preferably at most 20 kg. In this way the second movable support structure is manually movable by a person.

In a preferred embodiment the arrangement comprises a movable working platform below the movable roof structure. Thus, installation work can be performed during elevator use between the first support structure and the movable roof structure. Preferably, the working platform is arranged to be moved by taking support from the movable roof structure. Thus, several functions can be installed into this movable structure, and accessed simultaneously.

In a preferred embodiment the elevator arrangement comprises a lifting device for lifting the roof structure and/or a lifting device for lifting a movable working platform below the movable roof structure in unity of the movable roof structure, preferably below a water-proof roof part thereof. Preferably the elevator arrangement further comprises a power supply to the lifting device(s), the power supply being preferably electrical power supply line and the lifting device(s) being electrical lifting device(s).

In a preferred embodiment the lifting arrangement comprises the second support structure, a rope or equivalent, and a lifting device, the lifting device being in unity of the movable roof structure.

In a preferred embodiment the movable roof structure comprises a platform on which a person can walk and a water-proof roof part above the platform.

In a preferred embodiment the lifting device(s) positioned in unity of the that the movable roof structure is/are accessible via the platform, preferably fixed to the platform.

In a preferred embodiment the elevator arrangement comprises a power supply to the lifting device(s) positioned in unity of the movable roof structure, the power supply being preferably electrical power supply line and the lifting device(s) being electrical lifting device(s).

The construction-time elevator arrangement is preferably installed inside a building, the car traveling vertically, preferably responding to landing calls and/or car calls. The car has preferably an interior space suitable for receiving passenger or passengers. The car is preferably arranged to serve two or more landings. These qualities are preferably present also in the final and permanently present elevator constructed with the method/elevator arrangement. The hoistway is preferably inside the building. The building is preferably a tower building.

BRIEF DESCRIPTION OF THE DRAWINGS

In the following the present invention will be described in more detail by way of example and with reference to the attached drawings, in which.

DETAILED DESCRIPTION

Figure 1:
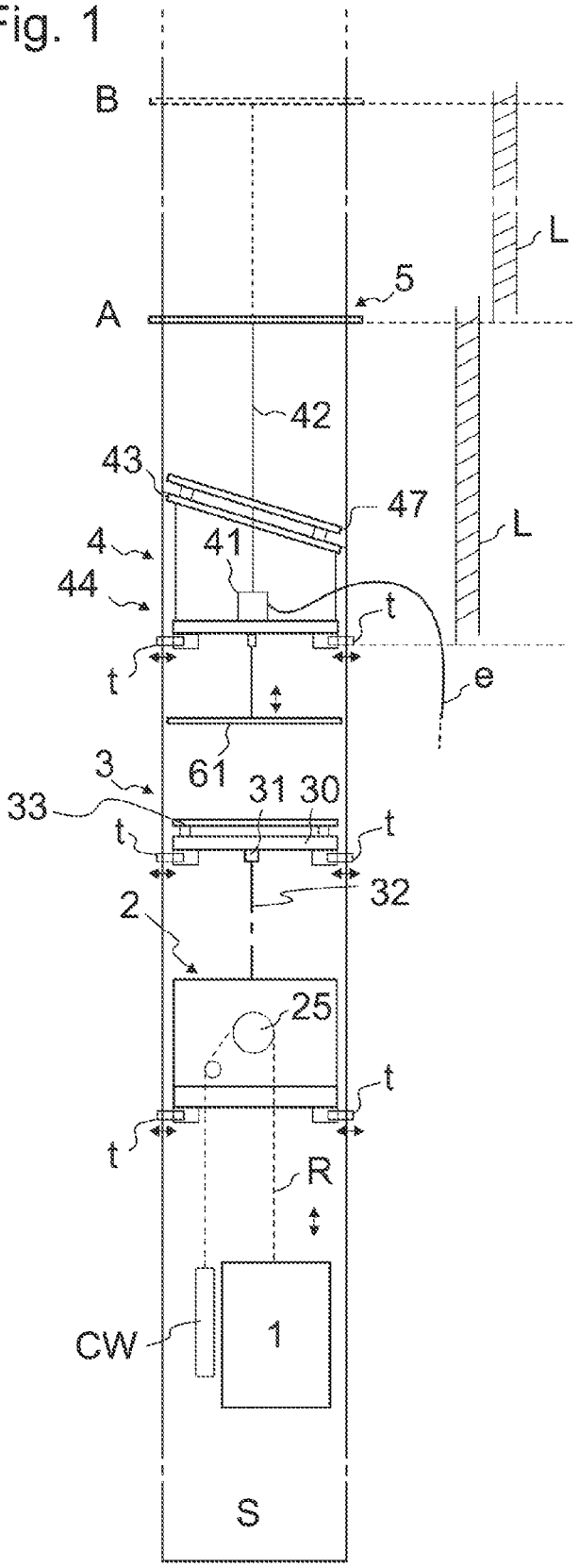
FIG. 1 illustrates an overview of the elevator arrangement according to an embodiment of the invention where method steps of the invention can be performed.

In FIG. 1 it is illustrated a preferred embodiment where the elevator arrangement has been arranged to comprise during construction time a hoistway S, and an elevator unit 1 movable in the hoistway S, the elevator unit being an elevator car 1 for transporting passengers and/or goods. The elevator arrangement may also comprise additionally other movable elevator units such as the counterweight CW, as depicted. The elevator arrangement further comprises a first movable support structure 2 in the hoistway above the elevator car 1, for supporting said at least one elevator unit (1,CW), in this case with a roping R connected between elevator unit(s) and the support structure 2. The elevator arrangement further comprises a roof structure 4, separate from the movable support structure 2, in the hoistway S above the support structure 2, and a lifting arrangement (41,42,5) in the hoistway S for lifting the movable roof structure 4 higher in the hoistway S. The roof structure 4 is a movable support structure, and the lifting arrangement (41,42,5) comprises a second movable support structure 5 mounted in the hoistway S above the movable roof structure 4, the lifting arrangement (41,42,5) being arranged to take support from the second movable support structure 5 for said lifting of the movable roof structure 4. Roof structure 4 can be lifted upwards separately from the movable support structure 2 so as to make room between them. In the method the elevator car 1 is used for transporting passengers and/or goods (step a). The top part of the elevator hoistway S above the support structure 2 can be constructed at the same time as an elevator car moving in the bottom part of the elevator hoistway already serves people on the lower floors of the building. When the elevator hoistway under construction above the movable support structure 2 has reached a sufficient stage of completion, the completed part of the elevator hoistway S can be taken into use. In this case elevator car is taken out of said use and a jump-lift is performed, wherein the movable support structure 2 is lifted (step b) and mounted to a higher position in the elevator hoistway. After this the elevator car 1 is taken back to said use for transporting passengers and/or goods.

FIG. 1 also show a third support structure 3 between the roof structure 4 and the supports structure 2 wherefrom support is taken for the lift of the first support structure 2 in step b. The lifting of the first support structure 2 can be performed with a lifting device 31 pulling the first support structure 2 with a rope system 32 up. The lifting device 31 may be in unity of the first or third support structure, fixed to the lifting beam 30, for instance. However, the lifting of the support structure 2 need not be carried in this particular fashion as alternative arrangements exist. Before step b the third support structure 3 can be lifted higher in the hoistway taking support from the roof structure 4. For this purpose the movable roof structure 4 may comprise a lifting device 61 connected/connectable via a rope system 62 to the third support structure 3.

Supported by the lifting beam 30 is a separation deck 33. The separation deck 33 is an impact absorbing sandwich structure 80 shown in FIG. 6. The sandwich structure 80 comprises a first skin 81 and a second skin 85 and one or more core elements 82, 83, 84 between the first skin 81 and the second skin 85. The core elements 82, 83, 84 comprise a plywood plate 82, a steel plate 83, and a corrugated metal sheet 84 between the steel plate 83 and the second skin 85. The first skin 81 and the second skin 85 and the corrugated metal sheet 84 are steel plates of thickness 2-10 mm, preferably of thickness 3-6 mm.

Figure 6:
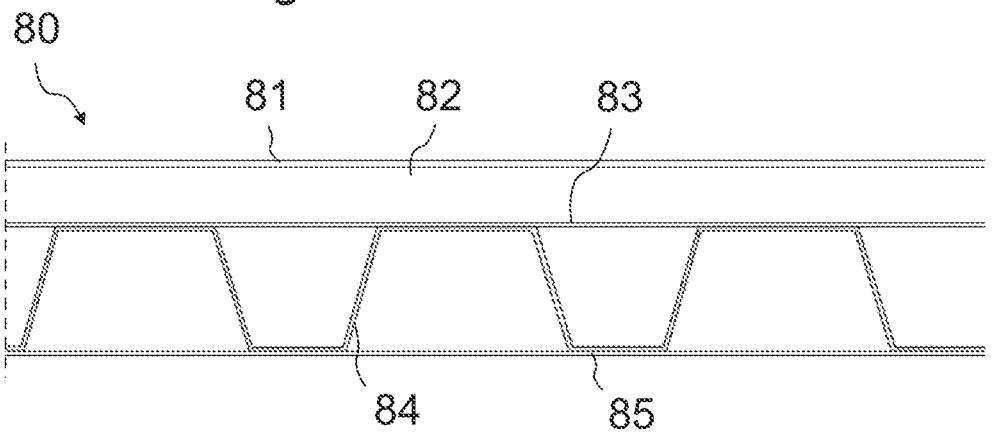
FIG. 6 illustrates the sandwich structure of the protection deck/separation deck.

In FIG. 6 one advantageous embodiment of the stacking sequence of the sandwich structure 80 from the bottom to the top of the deck is shown. However, depending on the mechanical properties desired for the deck 33, 47, the stacking sequence of the sandwich structure 80 might be different or comprise additional layers of core elements 82, 83, 84.

The number of steel plates 83 in the sandwich structure 80 is one, two, or more depending on the impact absorbing protection capacity desired for the separation deck 33. Also the number of plywood plates 82 can be one, two, or more depending on the on the impact absorbing protection capacity desired for the separation deck 33. The plywood plate's thickness is preferably 5-10 mm. The impact absorbing sandwich structure 80 is formed by joining said core elements 82, 83, 84 together and to the first skin 81 and the second skin 85 by adhesive bonding, welding, spot welding, riveting or by press-formed joints.

FIG. 1 also shows a movable working platform 61 below the movable roof structure 4, wherefrom elevator structures are installed by working on the working platform during said use of car 1. The working platform is moved by taking support from the movable roof structure 4 mounted above the working platform 61. For lifting of the third movable support structure 3 the movable working platform may be connected to the movable working platform 61. The lifting device 61 need not be positioned in unity of the movable roof structure, but instead it could be positioned in unity of the working platform 61.

Figure 2:
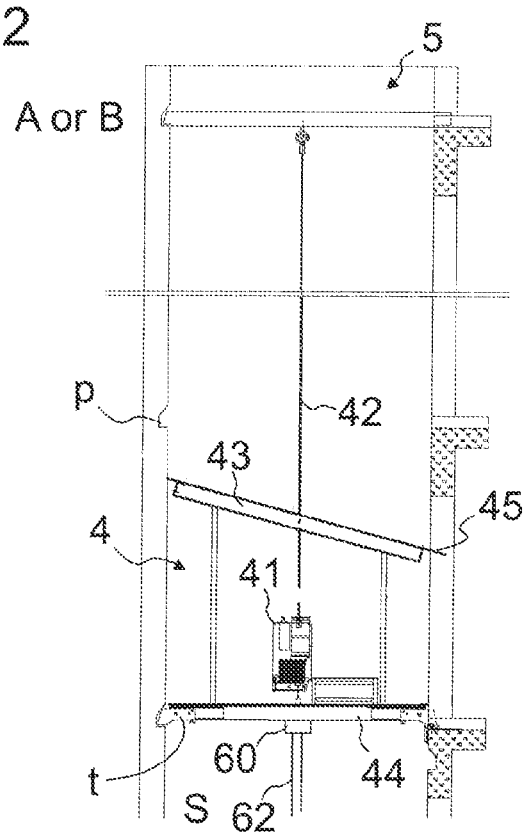
FIG. 2 illustrates the elevator arrangement before step x.
Figure 3:
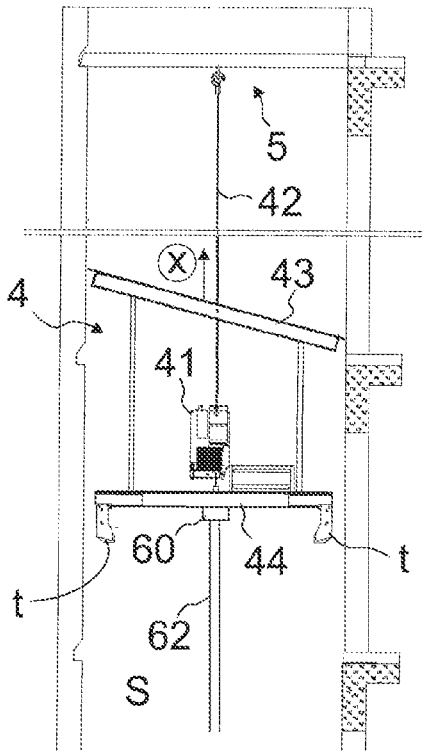
FIG. 3 illustrates the elevator arrangement when step x is being performed.

When a suitable number of jump-lifts has been performed (cycles of steps a to c), for example the support structure 2 has become close to said roof structure 4, the movable roof structure 4 is lifted (step x) higher in the hoistway S so as to make more room below it. For this purpose the roof structure 4 is made to be a movable roof structure, having supporting means t transferrable to a state where they don't block vertical movement of the movable roof structure 4, such as laterally extendable support elements. FIG. 2 illustrates a preferred arrangement before step x and FIG. 3 illustrates step x. In step x the movable roof structure 4 is lifted in the hoistway S taking support for the lift from a second movable support structure 5 mounted in the hoistway S above the roof structure 4. As illustrated, means t have been transferred to unblocking state prior to the lifting of the movable roof structure 4. Step x is done when support structure 2 has been raised so close to roof structure 4 that more room is needed between them. Another reason for lifting the movable roof structure 4 could be that installation work of elevator components needs to be continued above the current level of the roof structure 4. The lifting of the movable roof structure 4 is arranged to be done without substantial dismantling of the roof structure 4, which is can be enabled by means t, which are also described elsewhere.

Figure 4:
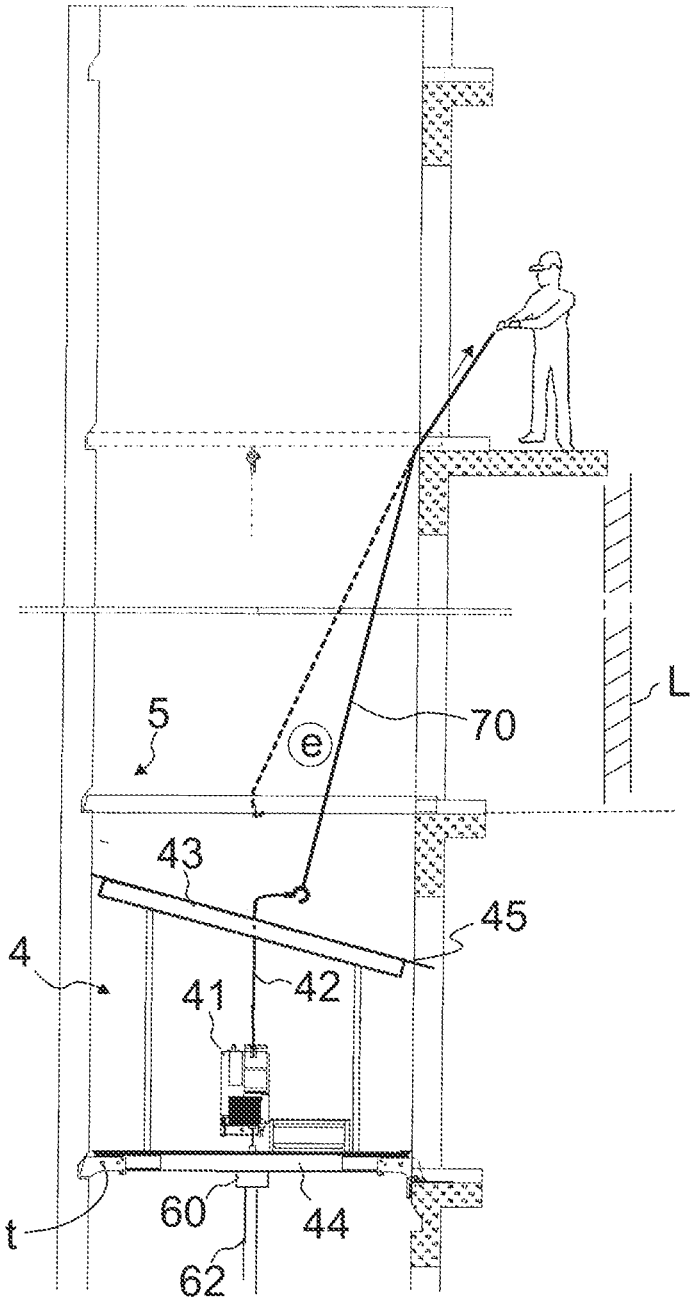
FIG. 4 illustrates the elevator arrangement when step e is being performed.

In step x the movable roof structure 4 is lifted with a lifting arrangement (41,42,5) which is in the hoistway S. The lifting arrangement (41,42,5) comprises the second movable support structure 5, and preferably also a rope 42, and a lifting device 41. Alternatively, other lifting means could be used instead of rope 42 and device 41. For enabling a subsequent step x the second movable support structure 5 is mounted in the hoistway S in a mounting position (A or B) above the movable roof structure 4 as illustrated in FIG. 1. This mounting can be done at a suitable moment before step x. In FIG. 1 mounting position A illustrates a mounting position where the second movable support structure 5 is to be mounted to perform step x possibly for the first time. Mounting position B illustrates a mounting position where the second movable support structure 5 is to be mounted after already performing step x, thus being higher than mounting position A. In both cases the lifting arrangement can be made to extend to the level of mounting position (A or B) for a subsequent step x by lifting the second movable support structure 5 to the level of its mounting position (A or B) from its earlier position. This can be done by performing step e as described elsewhere in the application, for instance. Step x can be performed once, or alternatively plural times to stepwise make more room below the roof structure 4. In case of plural steps x, after performing a preceding step x, the lifting arrangement is lifted to extend to the level of mounting position B for a subsequent step x. This is done preferably by step e where the second movable support structure 5 is moved from its earlier mounting position A upwards to a higher mounting position B in the hoistway S. Step e is illustrated in FIG. 4. After performing step e step x is performed.

In step e the lifting arrangement (41,42,5) is lifted to extend to the level of mounting position (A or B) for a subsequent step x. Said level of the mounting position (A,B) is above the level of the movable roof structure 4. This lifting is preferably done at least partially manually by a person, preferably by carrying or by pulling up with a rope or equivalent 70. Thus, no complicated lifting system is needed to move the point of support higher in the hoistway S. The person can climb ladders or stairs L up to the level of the intended mounting position A or B of the second movable support structure 5. He can carry the second movable support structure 5 up to this level (in one piece or in several) and mount it into position for lifting. To lift the rope 42 of the lifting arrangement to extend to the level of the higher mounting position the person preferably drops a pulling rope or equivalent 70 down to the movable roof structure 4 and subsequently it is connected to the rope or equivalent 42 of the lifting arrangement and the rope or equivalent 42 is pulled up with the rope or equivalent 70, as illustrated in FIG. 4. After this, the rope or equivalent 42 is connected to the second movable support structure 5 and the arrangement is ready for lifting. Alternatively, instead of carrying, the person can pull also the second movable support structure 5 up to the level of the higher mounting position B with the rope or equivalent 70 as illustrated with broken line in FIG. 4.

It is preferable, that after each step x the hoistway is sealed water-proof with the roof structure 4, e.g. by extending a water-proof membrane to extend up to the surface of the hoistway S. After the lifting of the movable roof structure 4, a step cycle comprising steps a to c can be performed once or plural times as there is now more room between them. After said cycle/cycles, steps e and x can be performed again. By performing the sequence of steps ((a+b+c)times n+e+x) suitable number of times, the structures 2 and 4 can be lifted as high in the hoistway as needed.

Figure 5:
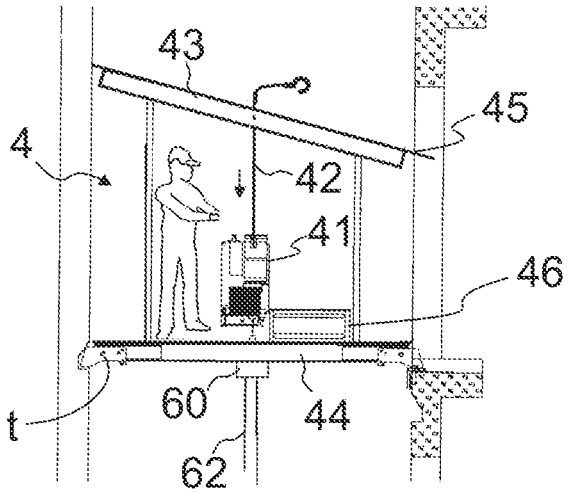
FIG. 5 illustrates the elevator arrangement when step x' is being performed.

FIG. 5 illustrates a preferred additional step x' performed after step x and before next step e. In step x' parts of the lifting arrangement 41, 42, 5 are lowered to be in unity of the movable roof structure 4 so as to store them the time between steps x and e. For this purpose, the lifting rope or equivalent 42 of the lifting arrangement is lowered to the unity of the roof structure 4, preferably below the water-proof roof part 43 thereof. Also the second support structure 5 is preferable to be positioned in this way below the water-proof part 43. Thus, they are stored safe from falling objects and water. Also, they are not in the way of not elevator related construction work taking place above the water-proof roof part 43. There may be a hole in the water-proof part 43 for the rope or equivalent 42, which hole can be sealed after the rope or equivalent is lowered below it. The rope 42 is preferably reeled on a reel 46 positioned below the water-proof part 43. After step x (particularly after step x' if this step is chosen to be performed), the hoistway is sealed water-proof with the roof structure 4, e.g. by extending a water-proof membrane to extend up to the surface of the hoistway S. When it is needed to perform step e again, then the second movable support structure 5 is mounted in the hoistway S above the roof structure 4 and rope 42 is connected to it as depicted in FIG. 4 for enabling next lift of the movable roof structure 4.

The initial lifting of the movable second supporting structure 5 to its mounting position A and lifting from mounting position A to the even higher mounting position B can be performed with step e substantially in corresponding ways (as described in context of FIG. 4). Also in case an earlier step x' has been performed, step e may be performed substantially in a corresponding way. The only difference may be in specific position of parts of lifting arrangement before step e. In all these cases said parts are before step e at a level lower than the intended mounting position (A or B) of the second movable support structure 5, the mounting position (A or B) being above the movable roof structure 4.

As mentioned, the second support structure 5 is movable. This means that it is demountably supportable in different vertical positions in the hoistway S. It can be made to be in form of a beam resting (e.g. resting freely or in releasably fixed manner) on top of stationary supporting structures of the elevator, such as upper surfaces of structures of the hoistway and a sill of the landing door opening. The roof structure 4 is movable, as well. This means that it is demountably supportable in different vertical positions in the hoistway. For this purpose, the construction-time elevator (the roof structure 4) has preferably been arranged to comprise supporting means t for supporting the roof structure 4 stationary in the elevator hoistway S, which means t are transferrable between state I where the roof structure 4 is supported stationary and state II where the roof structure 4 is not supported stationary. When in state II, the supporting means t do not block upwards directed vertical movement of the roof structure in the hoistway S. The first support structure 2 and/or the third support structure 3 are preferably made movable in corresponding manner as support structure 4.

The supporting means t preferably comprise laterally extendable support elements (for example as depicted in drawings). When in supporting state I, each support element may extend on top of a stationary supporting structure of the elevator, such as an upper surface of an elevator hoistway structure or a sill of the landing door opening. For this purpose, the hoistway S may be designed to have at intervals supporting structures. For instance, pockets p can be made in the hoistway walls. The support elements can be formed to be laterally extendable (and retractable back to non-extended state) by linear movement or by pivoting. The support elements are preferably lockable into extended and/or contracted state. In FIG. 1, the support elements are movable between said positions by linear movement and in FIGS. 2-4 by pivoting movement. The supporting means t could have alternatively have a different design. A preferred alternative design would be such that the means t are gripping means arranged to grip elevator guide rails when in state I and not grip when in state II. Such gripping means would preferably be in the form of a wedging-type gripper, having a wedging-part arranged to wedge between guide rail and an upwardly tapering housing surface of the gripper if the gripping means moves downwards, thus utilizing a structure well known from elevator safety gear-devices.

As shown in FIG. 1, the roof structure 4 may comprise a protection deck 47. The protection deck 47 is an impact absorbing sandwich structure 80 shown in FIG. 6. The sandwich structure 80 comprises a first skin 81 and a second skin 85 and one or more core elements 82, 83, 84 between the first skin 81 and the second skin 85. The core elements 82, 83, 84 comprise a plywood plate 82, a steel plate 83, and a corrugated metal sheet 84 between the steel plate 83 and the second skin 85. The first skin 81 and the second skin 85 and the corrugated metal sheet 84 are steel plates of thickness 2-10 mm, preferably of thickness 3-6 mm.

The number of steel plates 83 in the sandwich structure 80 is one, two, or more depending on the impact absorbing protection capacity desired for the protection deck 47. Also the number of plywood plates 82 can be one, two, or more depending on the on the impact absorbing protection capacity desired for the protection deck 47. The plywood plate's thickness is preferably of 5-10 mm. The impact absorbing sandwich structure 80 is formed by joining said core elements 82, 83, 84 together and to the first skin 81 and the second skin 85 by adhesive bonding, welding, spot welding, riveting or by press-formed joints.

The roof structure 4 is preferably waterproof. Thus, it stops water from entering the hoistway below it. Furthermore, the roof structure 4 and one or more sidewalls of the hoistway S are preferably sealed in waterproof manner. Preferably, it comprises a waterproof roof part 43, and a platform 44 below the waterproof roof part 43. For making the roof structure 4 waterproof, it preferably comprises a waterproof membrane 45 as part of the roof part 43. To facilitate water running away from the hoistway S, the movable roof structure 4 comprises a water-proof part 43 forming an inclined water-proof surface.

As mentioned, the second movable support structure 5 is preferably portable by a person or consists of plural portable (by a person) parts detachably connected. Thus, it can be carried or pulled by person (in one piece or several) to the level A or B which is the new mounting position thereof from a lower level. The second movable support structure 5 is preferably in the form of a beam. Thus it is simple and can be made rigid and reliable with low weight. A light but rigid beam structure 5 can be made from wood and/or metal. The weight of the second movable support structure is at most 35 kg, preferably at most 25 kg, more preferably at most 20 kg in weight or the second support structure consists of plural detachably connected parts each having a weight of 35 kg at most, preferably at most 25 kg, more preferably at most 20 kg.

The movable roof structure is preferably such that a lifting device 41 for lifting the roof structure 4 is in unity of the movable roof structure 4. Furthermore, the roof structure 4 may also comprise a lifting device 60 for lifting a working platform 61 below roof structure 4 (preferably with roping 62). The movable roof structure 4 preferably also comprises a power supply f to the lifting device(s) 41 and/or 60, the power supply being preferably electrical power supply line and the lifting device 41/60 being an electrical lifting device. Thus the lifting device(s) 41/60 can be accessed for used or maintenance easily. Also, power feed is in this way simple and preferably provides power for multiple devices with only one line. The lifting device(s) 41,60 is/are preferably accessible via the platform and preferably fixed to the platform 44. The lifting device 41 and/or the lifting device 60 is/are preferably remotely controllable, e.g. via a control cable or a wireless connection.

Parts 42, 62 and 70 are preferably ropes, such as metal ropes, but an equivalent flexible member could be used, such as a belt or chain. Correspondingly, roping R could be formed of ropes or equivalent components. With term portable structure it is meant structure that can be lifted manually by a person, particularly pulled up or carried by a person. In the embodiments described, the end of the rope 42 is connected to the structure 5 such that hoisting ratio is 1:1. However, this is not necessary as alternatively the rope 42 could be connected to the structure 5 by a pulley(s) such that 2:1 hoisting ratio is achieved or more pulleys such that even higher ratio is achieved. It is to be understood that the above description and the accompanying figures are only intended to illustrate the present invention. It will be obvious to a person skilled in the art that the inventive concept can be implemented in various ways, for instance with other materials/or other shapes of the cutting member than what is specified in the examples. The invention and its embodiments are not limited to the examples described above but may vary within the scope of the claims.

The invention claimed is:

1. A method of constructing an arrangement to install an elevator, the arrangement including at least one elevator unit including an elevator car, a first movable support structure and a second movable support structure arranged in a hoistway with a third movable support structure therebetween, such that the first movable support structure is configured to support the at least one elevator unit, the third movable support structure is configured to support the first movable support structure, and the second movable support structure is configured to support a movable roof structure arranged above the third movable support structure in the hoistway, the third movable support structure having a separation deck thereon to catch objects that fall from a movable working platform above the separation deck, the separation deck having an impact absorbing sandwich structure to dissipate a kinetic energy of the objects that fall from the movable working platform, the method comprising:

disabling the elevator car from moving in the hoistway;

first lifting the first movable support structure towards the movable roof structure in the hoistway while supporting a weight thereof by the third movable support structure;

enabling the elevator car to transport the objects after the first lifting; and second lifting, via a lifting arrangement while the elevator car is enabled, the movable roof structure higher in the hoistway when the first movable support structure approaches the movable roof structure a distance less than a first distance, wherein said second lifting increases the first distance.

2. The method according to claim 1, further comprising:

third lifting, via a second rope, at least part of the lifting arrangement to a level of a mounting position after the second lifting is performed.

3. The method according to claim 2, wherein the third lifting includes at least one of lifting a first rope attached to the second movable support structure and the second movable support structure to the level of the mounting position.

4. The method according to claim 2, wherein the third lifting includes, dropping the second rope vertically in the hoistway, connecting the second rope to the part of the lifting arrangement, and lifting the part by pulling the second rope.

5. The method according to claim 2, wherein as the second lifting moves the movable roof structure higher in the hoistway, the movable roof structure approaches the second movable support structure, and the method further comprising:

fourth lifting the second movable support structure higher in the hoistway such that the fourth lifting increases a second distance between the second movable support structure and the movable roof structure.

6. The method according to claim 1, wherein the impact absorbing sandwich structure includes a first skin, a second skin, and one or more core elements between the first skin and the second skin.

7. The method according to claim 6, wherein the one or more core elements comprise:

a fiber board, a steel plate, and a corrugated sheet, the corrugated sheet being vertically superimposed between the steel plate and the second skin.

8. The method according to claim 1, wherein the lifting arrangement includes the second movable support structure arranged in a mounting position above the movable roof structure, a first rope and a lifting device.

9. The method according to claim 1, wherein the third movable support structure is lifted higher in the hoistway using the support of the movable roof structure, before the first lifting is performed.

10. The method according to claim 1, wherein the movable working platform is below the movable roof structure, the movable working platform configured to provide support to a user while the user is installing elevator structures.

11. The method according to claim 1, wherein after the second lifting, part of the lifting arrangement is lowered below a water-proof roof part of the movable roof structure.

12. The method according to claim 1, wherein the second lifting includes lifting the movable roof structure with the lifting arrangement in the hoistway, the lifting arrangement including a lifting device within the movable roof structure.

13. The method according to claim 1, wherein the movable roof structure comprises:

a protection deck with an impact absorbing sandwich structure.

14. An elevator installation arrangement, comprising:

a hoistway;

at least one elevator unit including an elevator car movable in the hoistway;

a movable roof structure configured to protect the hoistway;

a plurality of movable support structures including a first movable support structure and a second movable support structure arranged in the hoistway with a third movable support structure therebetween, such that the first movable support structure is configured to support the at least one elevator unit, the third movable support structure being configured to support the first movable support structure, and the second movable support structure being configured to support the movable roof structure arranged above the third movable support structure in the hoistway;

a lifting arrangement configured to lift the movable roof structure higher in the hoistway to increase a first distance between the first movable support structure and the movable roof structure while the elevator car is enabled, the lifting arrangement including the second movable support structure arranged above the movable roof structure, the second movable support structure configured to support the movable roof structure while lifting the movable roof structure;

a movable working platform below the movable roof structure; and a separation deck on the third movable support structure below the movable working platform to catch objects that fall from the movable working platform, the separation deck having an impact absorbing sandwich structure to dissipate a kinetic energy of the objects that fall from the movable working platform.

15. The elevator installation arrangement according to claim 14, wherein the movable roof structure comprises:

a platform configured to support a user thereon; and a water-proof roof part above the platform.

16. The elevator installation arrangement according to claim 15, wherein the movable roof structure further comprises:

a protection deck with an impact absorbing sandwich structure above the platform.

17. The elevator installation arrangement according to claim 14, wherein the impact absorbing sandwich structure comprises:

a first skin, a second skin, and one or more core elements between the first skin and the second skin.

18. The elevator installation arrangement according to claim 17, wherein the one or more core elements comprise:

a fiber board, a steel plate, and a corrugated sheet, the corrugated sheet being vertically superimposed between the steel plate and the second skin.

19. The elevator installation arrangement according to claim 14, wherein the movable roof structure includes a protection deck with an impact absorbing sandwich structure.

20. The elevator installation arrangement according to claim 14, wherein the movable roof structure includes a water-proof membrane configured to water-proof the movable roof structure.

21. The elevator installation arrangement according to claim 14, wherein the second movable support structure is portable or consists of detachably connected portable parts.

22. The elevator installation arrangement according to claim 14, wherein the lifting arrangement comprises:

the second movable support structure, a first rope, and a lifting device, the lifting device within the movable roof structure.

23. The elevator installation arrangement according to claim 14, further comprises:

a power supply connected to at least a lifting device associated with the lifting arrangement.

24. An elevator installation arrangement, comprising:

a hoistway;

at least one elevator unit including an elevator car movable in the hoistway;

a movable roof structure configured to protect the hoistway;

a plurality of movable support structures including a first movable support structure and a second movable support structure arranged in the hoistway with a third movable support structure therebetween, such that the first movable support structure is configured to support the at least one elevator unit, the third movable support structure being configured to support the first movable support structure, and the second movable support structure being configured to support the movable roof structure arranged above the third movable support structure in the hoistway;

a movable working platform below the movable roof structure; and a separation deck on the third movable support structure, the separation deck configured to catch objects that fall from the movable working platform above the separation deck, the separation deck having an impact absorbing sandwich structure to dissipate a kinetic energy of the objects that fall from the movable working platform.

* * * * *